US010723502B2

(12) United States Patent
Berkbigler

(10) Patent No.: US 10,723,502 B2
(45) Date of Patent: Jul. 28, 2020

(54) MODULAR TRAVEL STORAGE SYSTEM FOR LIQUIDS

(71) Applicant: BT. CONSULTING LLC, Phoenix, AZ (US)

(72) Inventor: Kimberlee Ann Berkbigler, Phoenix, AZ (US)

(73) Assignee: BT. CONSULTING LLC, Phoenix, AZ (US)

( * ) Notice: Subject to any disclaimer, the term of this patent is extended or adjusted under 35 U.S.C. 154(b) by 49 days.

(21) Appl. No.: 16/231,766

(22) Filed: Dec. 24, 2018

(65) Prior Publication Data

US 2020/0198828 A1 Jun. 25, 2020

(51) Int. Cl.

| | |
|---|---|
| ***B65D 1/30*** | (2006.01) |
| ***B65D 1/18*** | (2006.01) |
| ***B65D 1/36*** | (2006.01) |
| ***B65D 21/02*** | (2006.01) |
| ***B65D 43/16*** | (2006.01) |
| ***B65D 25/04*** | (2006.01) |
| ***B65D 21/08*** | (2006.01) |
| *B65D 85/00* | (2006.01) |

(52) U.S. Cl.

CPC ..... *B65D 1/30* (2013.01); *B65D 1/18* (2013.01); *B65D 1/36* (2013.01); *B65D 21/0204* (2013.01); *B65D 21/0208* (2013.01); *B65D 21/083* (2013.01); *B65D 25/04* (2013.01); *B65D 43/162* (2013.01); *B65D 85/70* (2013.01); *B65D 2251/0018* (2013.01); *B65D 2251/1016* (2013.01); *B65D 2251/20* (2013.01)

(58) Field of Classification Search

CPC ..... B65D 1/30; B65D 1/18; B65D 21/0204; B65D 21/083; B65D 85/345; B65D 2251/0018; B65D 1/36; B65D 21/0208; B65D 2251/1016; B65D 2251/20

USPC ..... 206/151, 223, 431, 477, 478, 481, 206/145–149, 154, 159, 160, 459.5

See application file for complete search history.

(56) References Cited

U.S. PATENT DOCUMENTS

| | | | | |
|---|---|---|---|---|
| 3,664,497 | A * | 5/1972 | Mascia | B65D 71/50 206/151 |
| 3,669,258 | A * | 6/1972 | Mascia | B65D 71/50 206/151 |
| 5,375,709 | A * | 12/1994 | Petro | B65D 21/083 206/509 |
| 5,890,613 | A * | 4/1999 | Williams | A45C 7/0045 220/23.4 |
| 8,439,196 | B2 * | 5/2013 | Kemper | B65D 43/022 206/430 |
| 2001/0035430 | A1 | 11/2001 | Litscher | |
| 2002/0195369 | A1 | 12/2002 | Bergman | |
| 2005/0000962 | A1 | 1/2005 | Crawford et al. | |
| 2006/0000837 | A1 | 1/2006 | Watson et al. | |
| 2006/0102656 | A1 | 5/2006 | Troost et al. | |

(Continued)

*Primary Examiner* — Rafael A Ortiz

(74) *Attorney, Agent, or Firm* — Olav M. Underdal; IDP Patent Services

(57) ABSTRACT

A modular travel storage system for transporting liquids, gels, and powders, includes: a holder portion with a plurality of container receptors, including left, right, rear, and top walls, with left, right, and rear inner ledges; and a plurality of container pods, each including a container body with left, right and rear protruding rims, and a lid; such that each container pod slides into a corresponding container receptor.

18 Claims, 7 Drawing Sheets

(56) References Cited

U.S. PATENT DOCUMENTS

| | | | | |
|---|---|---|---|---|
| 2011/0121002 | A1* | 5/2011 | Stiller | A45C 11/20<br>220/504 |
| 2012/0279960 | A1 | 11/2012 | Herndon et al. | |
| 2015/0259096 | A1 | 9/2015 | Kumar | |
| 2015/0274369 | A1* | 10/2015 | Doignon | B65D 51/245<br>206/459.5 |
| 2016/0137364 | A1* | 5/2016 | Pirrella | B65D 51/245<br>206/459.5 |
| 2019/0084756 | A1* | 3/2019 | Maxwell | B65D 85/345 |

* cited by examiner

Modular Travel Storage System

Holder Section

Container Pod

MODULAR TRAVEL STORAGE SYSTEM FOR LIQUIDS

CROSS-REFERENCE TO RELATED APPLICATIONS

N/A.

FIELD OF THE INVENTION

The present invention relates generally to the field of liquid storage container, and more particularly to methods and systems for storage of multiple liquids during travel, including airline travel.

BACKGROUND OF THE INVENTION

Travelers in the United States and internationally must comply with regulations for bringing liquids onboard a flight in carry-on luggage. In the US, flight passengers are allowed to bring a quart-sized re-sealable zipper storage bag of liquids, aerosols, gels, creams and pastes in their carry-on bag and through security checkpoints. These are limited to travel-sized containers that are 3.4 ounces (100 milliliters) or less per item.

However, there are a number of inconveniences associated with this. Particularly travelers have to purchase separate travel-size products, and the contents of quart-sized re-sealable zipper storage bags tends to become disorganized. Additionally, preferred brands may not be available in travel-sized containers.

As such, considering the foregoing, it may be appreciated that there continues to be a need for novel and improved devices and methods for storage of multiple liquids during travel.

SUMMARY OF THE INVENTION

The foregoing needs are met, to a great extent, by the present invention, wherein in aspects of this invention, enhancements are provided to the existing model of modular travel storage systems for traveling.

In an aspect, a modular travel storage system for transporting liquids, gels, powders, and other materials can include:

a) a holder portion with a plurality of container receptors; and b) a plurality of container pods, which each enclose a container interior;

wherein each container pod is detachably connectable to a corresponding container receptor.

In a related aspect, each container pod can include a lid, which when opened provides access to the container interior.

In another related aspect, each container pod comprises a container body, which encloses the container interior, wherein the lid is hingedly connected to the container body with a hinge.

In yet a related aspect, the hinge can be a living hinge.

In yet another related aspect, each container receptor can be configured as a container slot, such that a corresponding container pod slides into the container slot from an outer side of the holder section.

In a further related aspect, the container slot can include:

left and right slot walls, further comprising left and right inner ledges that protrude inwards along inner sides of the left and right slot walls.

In another further related aspect, each container pod can include:

a) a container body, which encloses the container interior, such that an upper opening of the container body provides access to the container interior;

b) left and right rims that protrude outward along upper parts of left and right outer sides of the container body;

such that the left and right rims are configured to slide in over the left and right inner ledges to lock the container pod in place in the container slot.

In yet another further related embodiment, a container pod can include:

a) a container body, that encloses an interior, such that an upper opening of the container body provides access to the container interior, wherein the container body includes a protruding lip;

b) a collar member, which fits along an entire outer side of the container body, such that the collar member includes:

i. left and right rims that protrude outward along upper parts of left and right outer sides of the collar member; and c) a lid, which can be hingedly connected to the collar member with a hinge;

such that the collar member can slide up along the outer side of the container body, such that the collar member can be positioned in place against the protruding lip of the collar member, such that the collar member can be removable from the container body, by opening the lid fully and sliding the collar member down along the container body, such that the collar member is separated from the container body;

such that left and right of the collar member can be configured to slide in over respectively the left and right to secure the container pod in place in the container slot;

such that the container pod when mounted in the holder portion provides a tight sealing, which can be water-tight, air-tight, and powder-tight.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 18 is a bottom perspective view of a modular travel storage system, according to an embodiment of the invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1A:
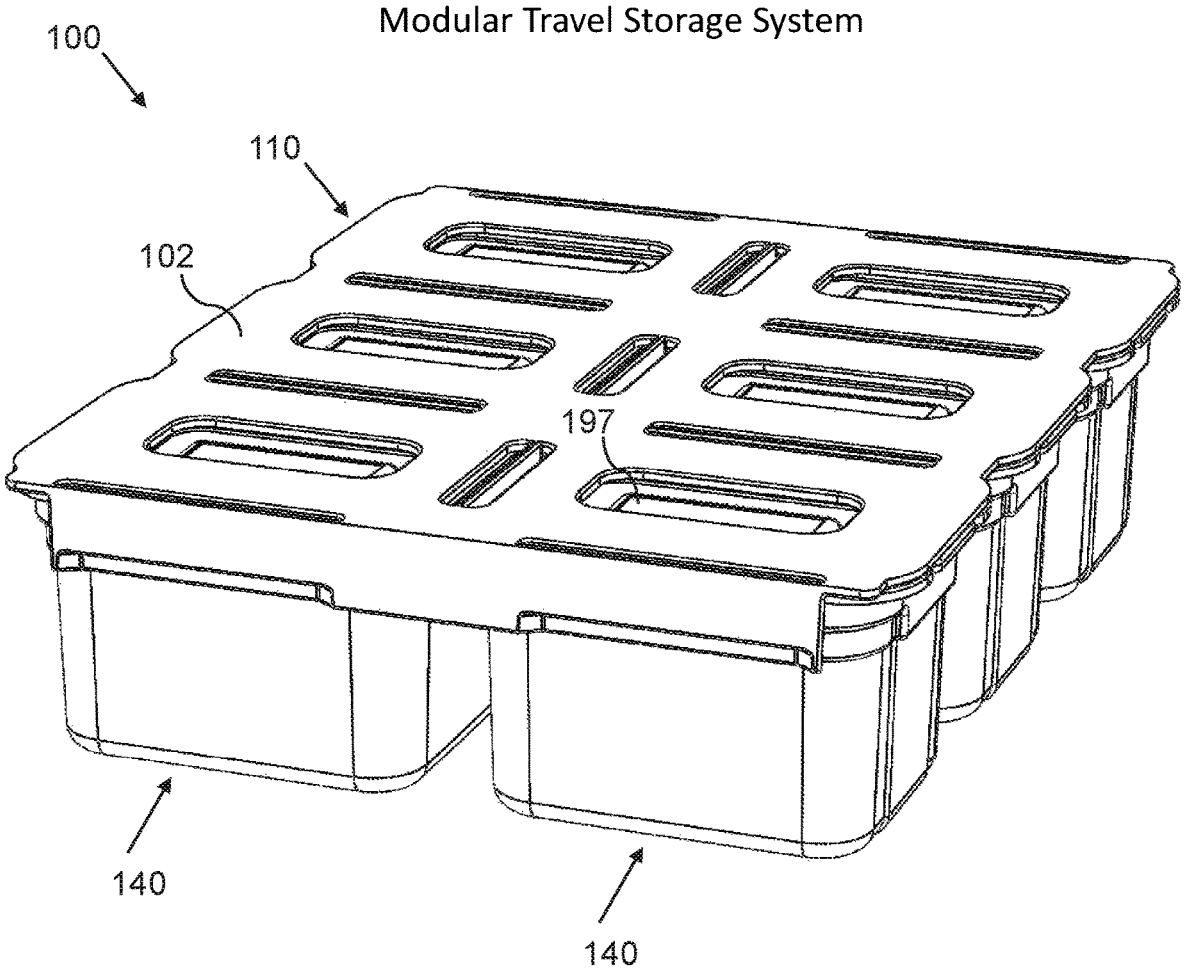
FIG. 1A is a top perspective view of a modular travel storage system, according to an embodiment of the invention.
Figure 1B:
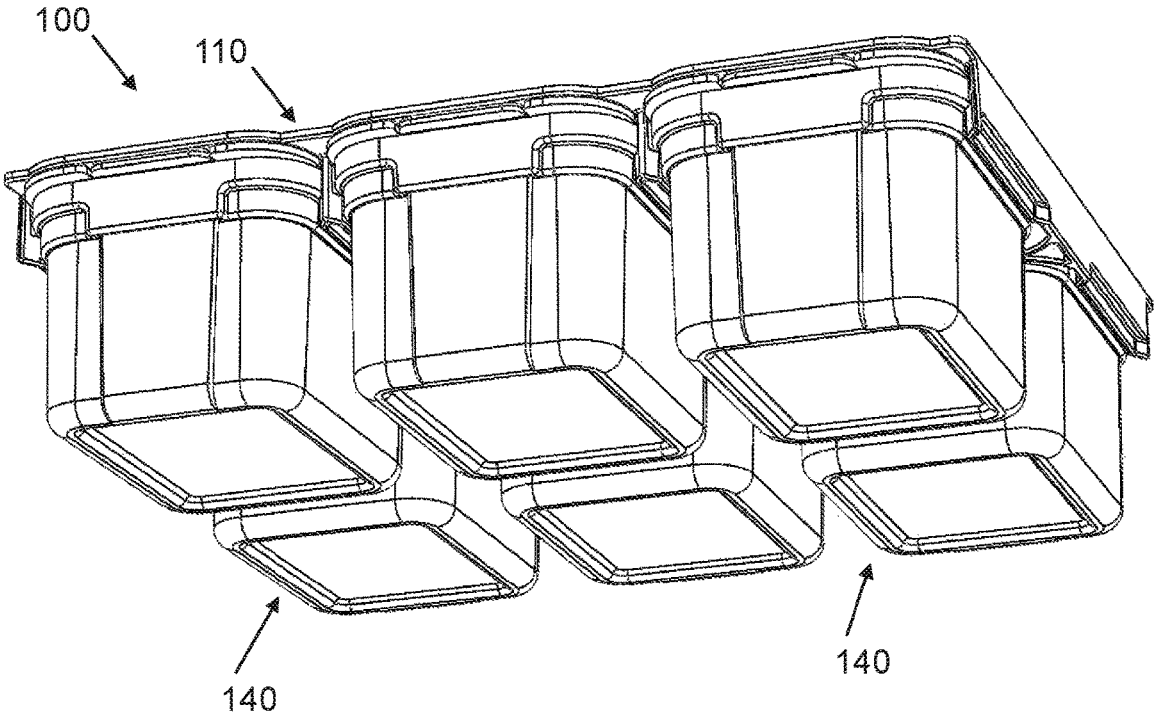
FIG. 1C is a cross-sectional view of a modular travel storage system, according to an embodiment of the invention.
Figure 1C:
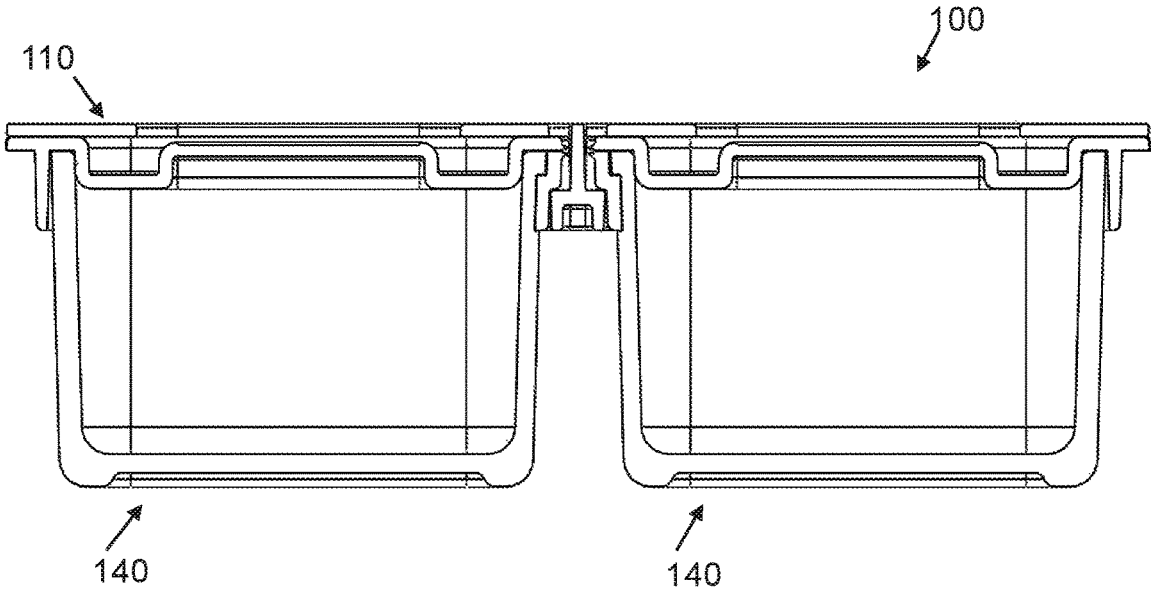

In the following, we describe the structure of an embodiment of a system for modular travel storage system 100 with reference to FIG. 1A, in such manner that like reference numerals refer to like components throughout; a convention that we shall employ for the remainder of this specification.

Figure 2A:
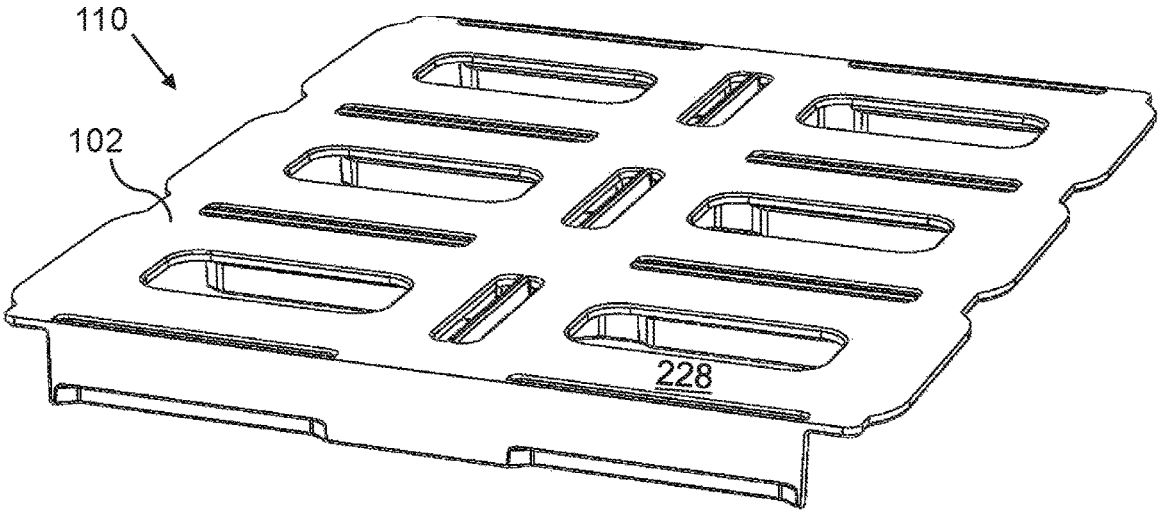
FIG. 2A is a top perspective view of a holder section of a modular travel storage system, according to an embodiment of the invention.
Figure 2B:
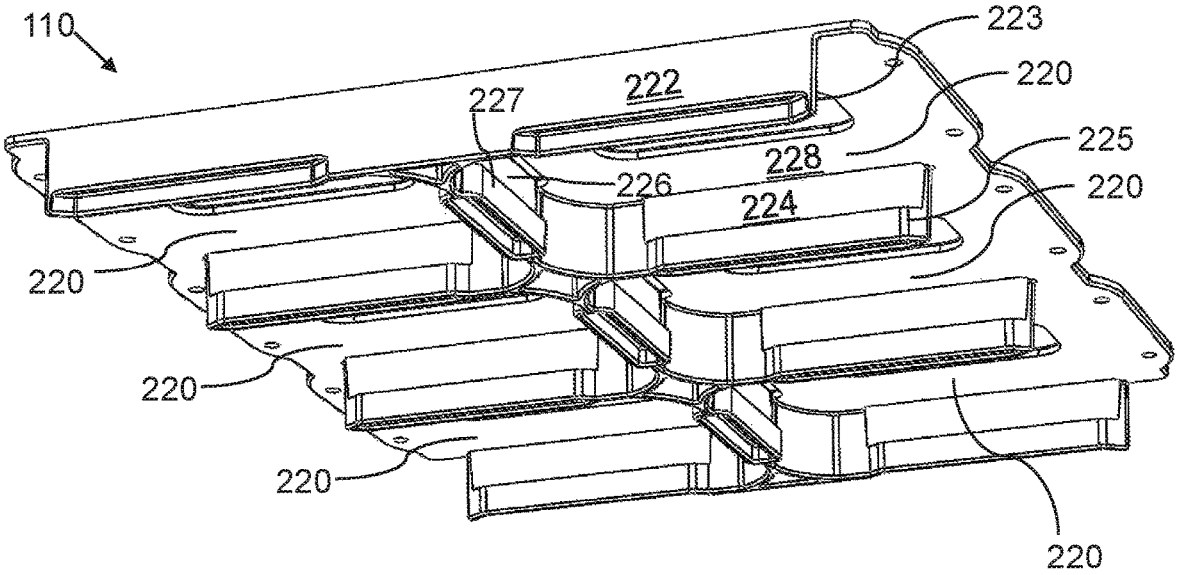
FIG. 2B is a bottom perspective view of a holder section of a modular travel storage system, according to an embodiment of the invention.
Figure 2C:
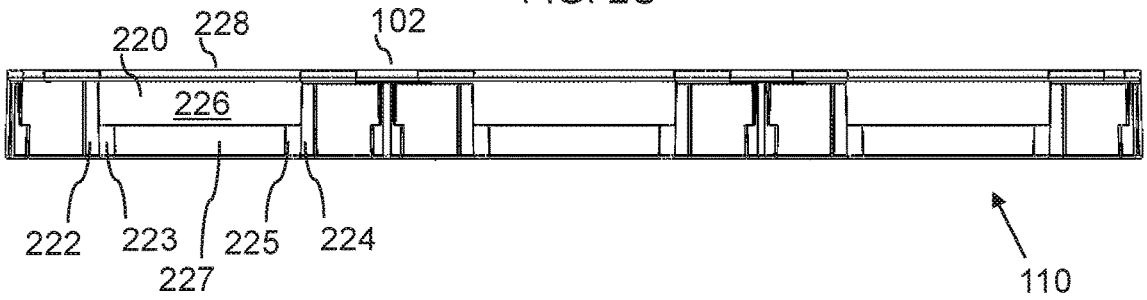
FIG. 2C is a front view of a holder section of a modular travel storage system, according to an embodiment of the invention.
Figure 3A:
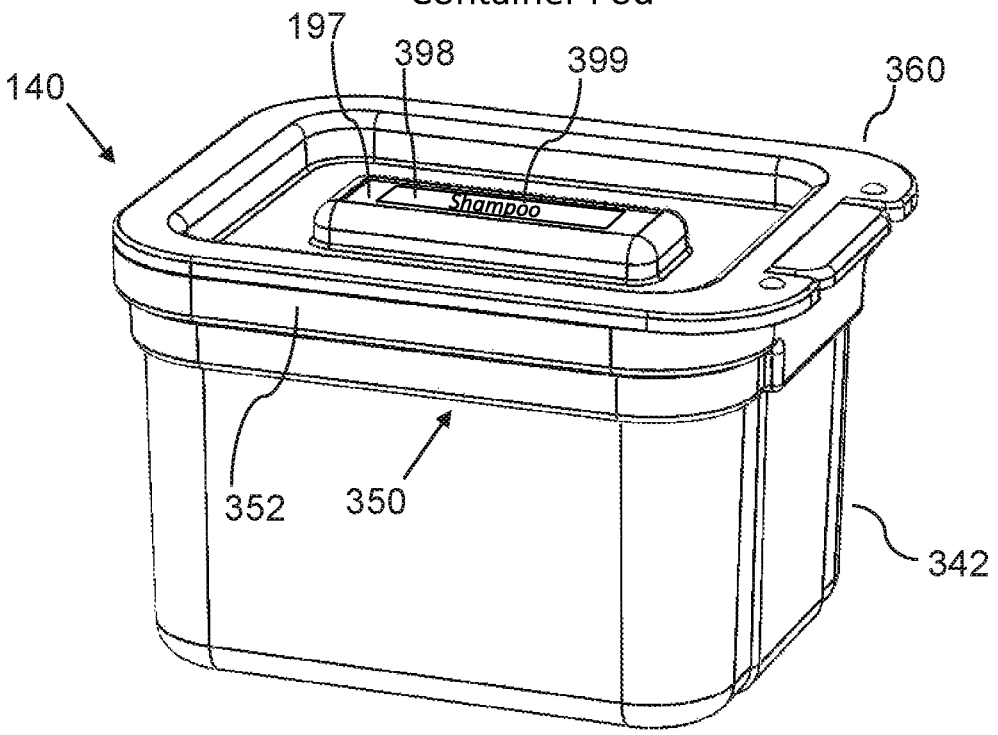
FIG. 3A is a top perspective view of a container pod in a closed configuration, according to an embodiment of the invention.
Figure 3B:
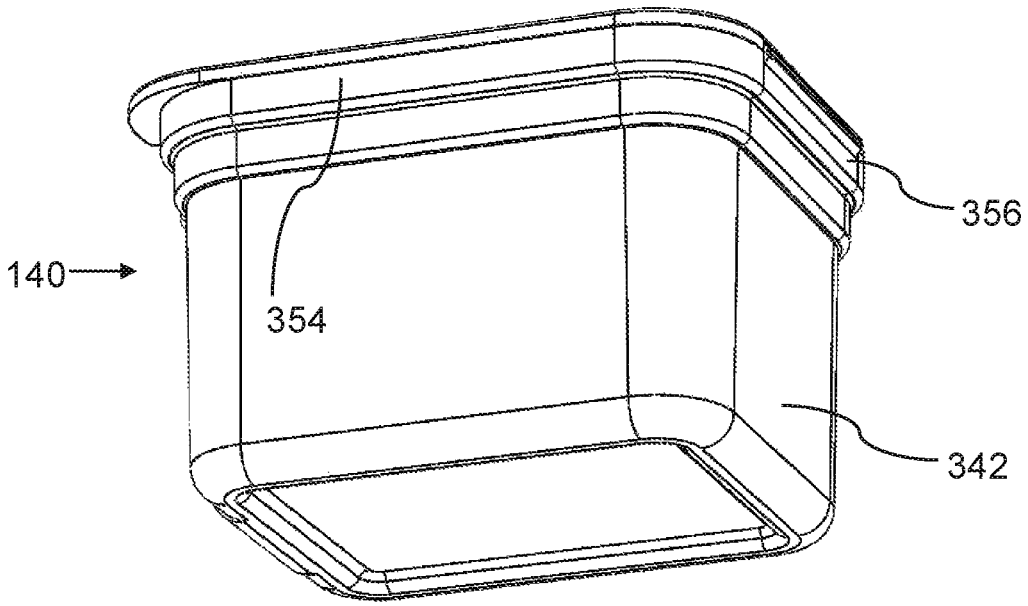
FIG. 3B is a bottom perspective view of a container pod in a closed configuration, according to an embodiment of the invention.
Figure 3C:
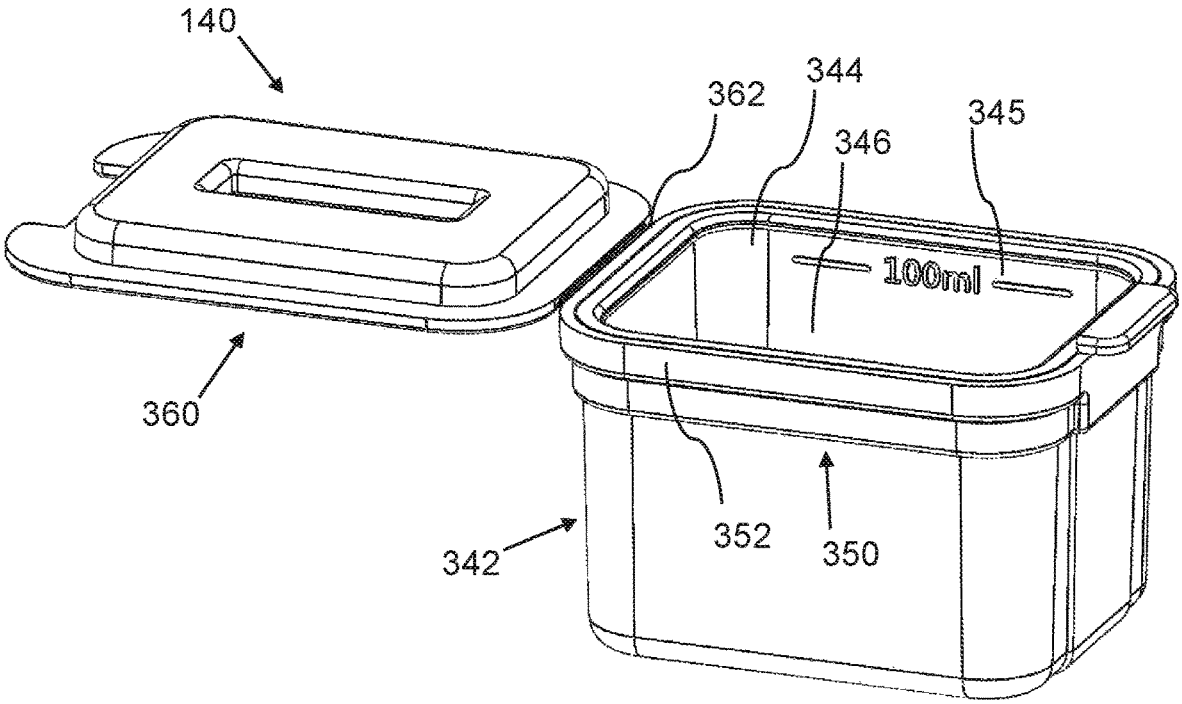
FIG. 3C is a top perspective view of a container pod in an open configuration, according to an embodiment of the invention.
Figure 3D:
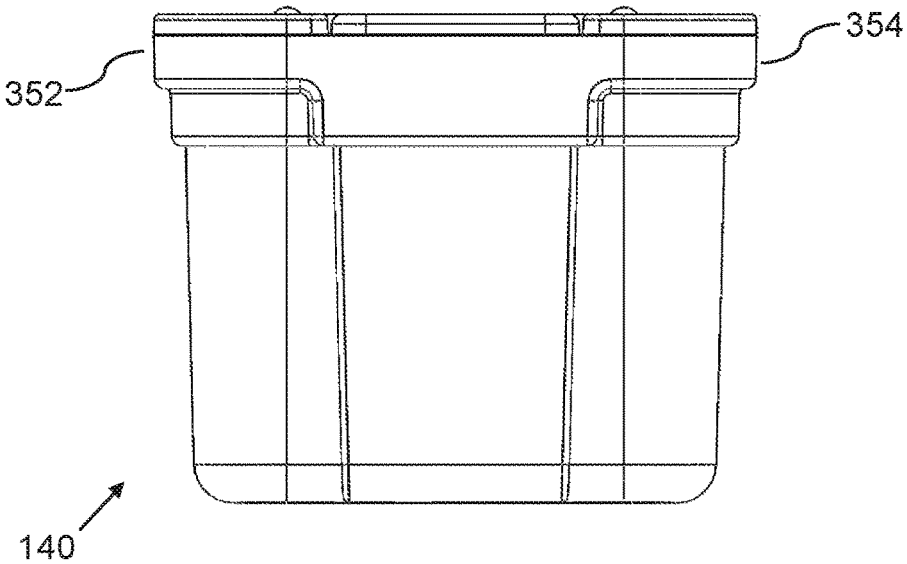
FIG. 3D is a front view of a container pod in a closed configuration, according to an embodiment of the invention.
Figure 3E:
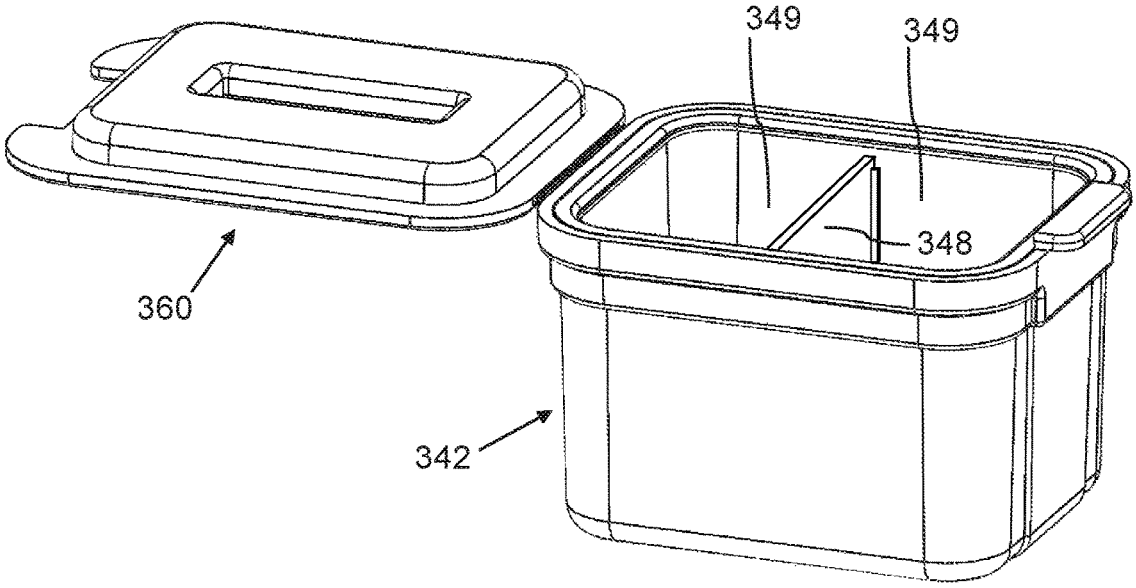
FIG. 3E is a top perspective view of a container pod in an open configuration, according to an embodiment of the invention.

In an embodiment, as shown in FIGS. 1A, 1B, 1C, 2A, 2B, and 2C a modular travel storage system 100 for transporting liquids, gels, powders, and other materials can include:

a) a holder portion 110, which comprises:
   i. a plurality of container receptors 220, as shown in FIG. 2B; and
b) a plurality of container pods 140, which each enclose a container interior, wherein each container pod is detachably connectable to a corresponding container receptor 220, wherein the container pods can comprise a container lid 360, which when opened provides access to the container interior 346, as shown in FIG. 3C.

In a related embodiment, as shown in FIG. 2B, each container receptor 220 can be configured as a container slot, such that a corresponding container pod 140 can slide into the container slot from an outer side of the holder portion 110, wherein each container slot, can include:

a) left and right slot walls 222 224, further comprising left and right inner ledges 223 225 that protrude inwards along lower parts of inner sides of the left and right slot walls 222 224;
b) a rear wall 226 further comprising a rear inner ledge 227 that protrudes inward along a lower part of an inner side of the rear wall 226; and
c) a top wall 228, also called a ceiling 228, which is mounted between top ends of the left and right slot walls 222 224. As shown, the top wall 228 can be a part of a top plate 102 of the holder portion 110.

In a related embodiment, as shown in FIGS. 3A, 3B, 3C, and 3D, each container pod 140 can include:

a) a container body 342, that encloses an interior 346, such that an upper opening 344 of the container body 342 provides access to the interior 346;
b) left and right rims 352 354 that protrude outward along upper parts of left and right outer sides of the container body 342;
c) a rear rim 356 that protrudes outward along an upper part of a rear outer side of the container body 342; and
d) a container lid 360, which can be hingedly connected to the container body 342 with a hinge 362, such that the container lid 360 closes the upper opening 344 when the lid 360 is in a closed configuration. The container lid 360 can be hingedly connected to the container body 342 either directly or via an intermediate member 350, such as a removable collar member 350, which is connected to or mounted on the container body 342;
   such that the left, right, and rear rims 352 354 356 can be configured to slide in over respectively the left, right, and rear inner ledges 223 225 227 to lock the container pod 140 in place in the container slot 220; such that the lid 360 can slide along the top wall 228, such that the lid 360 can be pressed against the top wall, such that the lid 360 is pressed closed, which thereby provides an additional sealing function of the lid 360, such that the container pod 140 when mounted in the holder portion 110 provides a tight sealing, which is water-tight, air-tight, and powder-tight.

In another further related embodiment, the hinge 362 can be a living hinge 362, as shown in FIG. 3C. In an example embodiment, the holder portion 110, lid 360, and rims 352 354 356 can be made of a plastic material, such as polypropylene or ABS, and can be transparent or translucent; and the container body 342 can be made from a plastic material or rubber material, such as silicone rubber, either of which can be transparent or translucent.

Figure 3F:
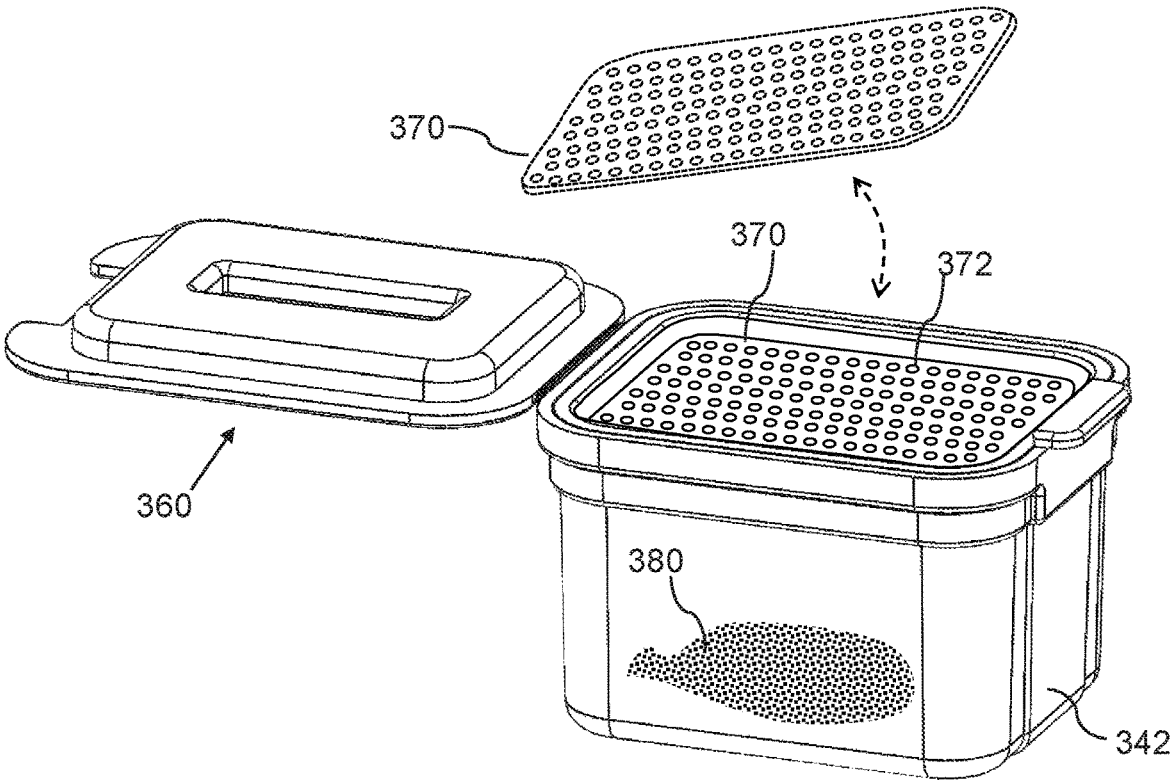
FIG. 3F is a top perspective view of a container pod in an open configuration, according to an embodiment of the invention.
Figure 3G:
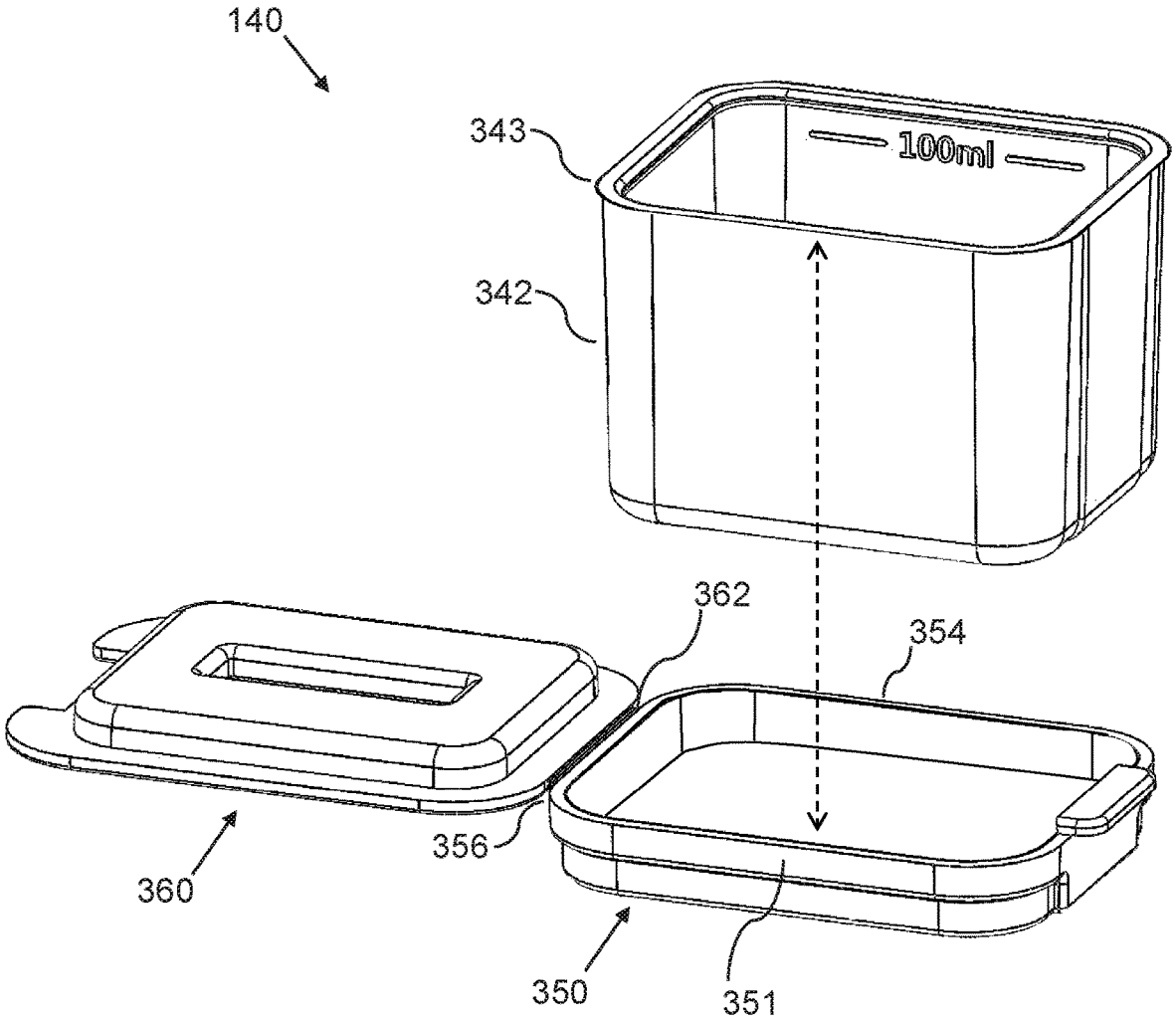
FIG. 3G is a top perspective view of a container pod in an open configuration, with a collar member and attached lid separated from the container body, according to an embodiment of the invention.

In another related embodiment, as shown in FIGS. 3A and 3G, a container pod 140 can include:

a) a container body 342, that encloses an interior 346, such that an upper opening 344 of the container body 342 provides access to the interior 346, wherein the container body includes a protruding lip 343 that protrudes outward from a top of the container body, around a top periphery of the container body 342;

b) a collar member 350, which is configured to fit along an entire outer side of the container body 342, such that the collar member 350 is a connected structure with a center aperture, as shown for example substantially rectangular with rounded corners, such that the collar member 350 further comprises a protruding rim 351 around a periphery of the collar member 350, wherein the protruding rim 351 comprises:

i. the left and right rims 352 354 that protrude outward along upper parts of left and right outer sides of the collar member 350; and ii. the rear rim 356 that protrudes outward along an upper part of a rear outer side of the container body 342; and c) a lid 360, which can be hingedly connected to the collar member 350 with a hinge 362, such that the lid 360 closes the upper opening 344 when the lid 360 is in a closed configuration;

such that the collar member 350 can slide up along the outer side of the container body 342, such that the collar member 350 is positioned and locked in place (typically by a friction fit) against the protruding lip 343 of the collar member 350, such that the collar member can be removable from the container body, by opening the lid 360 fully and sliding the collar member 350 down along the container body 342, such that the collar member 350 is separated from the container body 342, as shown in FIG. 3G;

such that left, right, and rear rims 352 354 356 of the collar member 350 can be configured to slide in over respectively the left, right, and rear inner ledges 223 225 227 to lock the container pod 140 in place in the container slot 220;

such that the lid 360 can slide along the top wall 228, such that the lid 360 can be pressed against the top wall 228, such that the lid 360 is pressed closed, which thereby provides an additional sealing function of the lid 360, such that the container pod 140 when mounted in the holder portion 110 provides a tight sealing, which is water-tight, air-tight, and powder-tight.

In a further related embodiment, the container body 342 can be transparent. Additionally, the holder portion 110 and the lid 360 can be transparent.

In a related embodiment, a container pod can further include a label area 197, which is a flat area on a top surface of the lid 360, which is configured to receive a content label 398, which includes a writing 399, including text 399 or symbols 399, such that the writing 399 indicates the type of content 380 inside the container body 342, when the content label 398 is applied to the label area 197, for example with an adhesive, such as a pressure sensitive adhesive that allows for removal of the content label.

In a related embodiment, as shown in FIG. 2A, the top wall 228 can include a window 229 or aperture 229, such that the content label 398 is visible through the aperture 229.

In related embodiments, the modular travel storage system 100 can be made from materials that are dishwashable, freezable, and recyclable, such as appropriate plastic materials.

In other related embodiments, the container pods 140 can be configured to each contain 25 ml, 50 ml, 100 ml, 200 ml, 300 ml, 25-200 ml, or other sizes, and can be more elongated or shallower than shown in the drawings. In further related embodiments, an inner side of the container body 342 can include a content marker line 345, for example as shown indicating a maximum content in milliliters, or in some other unit of measure, such as ounces or grams (typically with reference to water or standardized contents with a density of 1 gr/ml). An opposite inner side of the container body 342 may then show a content marker line 345 indicating the maximum contents in ounces (or grams).

In other related embodiments, the holder portion 110 can for example be configured to hold 2, 4, 6, 8, or 10 container pods 140 (when arranged in two rows as shown) but can also be designed to incorporate an unequal number of pods in one row only, as a linear arrangement with slide-in access from one side only.

In a related embodiment, a container pod 140 can include a built-in or removable divider 348, or a plurality of dividers 348, which divide the interior 346 into respectively two or a plurality of compartments 349.

In a related embodiment, a container pod 140 can include a removable inner lid 370, which comprises a plurality of apertures 372, wherein the inner lid 370 is mounted under the container lid 360 when the container lid 360 is closed, such that the container pod 140 can be opened by opening the container lid 360 and used for sprinkling a powder 380 that is stored in the interior 346 of the container body 342. The powder 380 is shown in FIG. 3F as visible through walls of the container body 342.

In various embodiments, the modular travel storage system 100 can:

a) decrease travel bottle usage, including:

i. Allow users to buy larger bottles of product and refill container pods 140 as needed;

ii. Reduce waste in Environment; and iii. Allow dishwasher safe usage;

b) Retain more product, due to square shape that allows access to every corner of container pods 140;

c) Allow easy change of products in container pods 140, including:

i. Easy change of amenity labels;

d) Provide reliable amenity labels, which:

i. Are easy to read;

ii. Will not smear or disappear if touched by product covered fingers; and iii. Are easy to change;

e) Provide more usable space in carry-on luggage, by taking up less wasted space in a TSA approved re-sealable zipper storage bag, due to a substantially square shape; and f) Save time passing through TSA security checkpoints in airports.

In various embodiments, the modular travel storage system 100 can be used for travel including day travel, several days, week long, or months long traveling.

Here has thus been described a multitude of embodiments of the modular travel storage system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A modular travel storage system, comprising:

a) a holder portion, which comprises:

a plurality of container receptors; and b) a plurality of container pods, which each enclose a container interior;

wherein each container pod is configured to be detachably connectable to a corresponding container receptor;

wherein each container receptor is configured as a container slot, such that a corresponding container pod is configured to slide into the container slot from an outer side of the holder portion;

wherein the container slot comprises:

left and right slot walls, further comprising left and right inner ledges that protrude inwards along inner sides of the left and right slot walls; and wherein each container pod comprises:

a container body, which encloses the container interior, such that an upper opening of the container body provides access to the container interior, wherein the container body includes a protruding lip, which protrudes outward from a top of the container body, around a top periphery of the container body;

a collar member, which is configured to fit around an entire outer side of an upper part of the container body, such that the collar member further comprises:

left and right rims that protrude outward along left and right outer sides of the collar member; and a container lid, which is hingedly connected to the collar member, such that the container lid closes the upper opening when the container lid is in a closed configuration;

such that the collar member is positioned against the protruding lip of the collar member;

such that the collar member is configured to be removable from the container body, by sliding the collar member down along the container body, such that the collar member is separated from the container body; and such that the left and right rims are configured to slide in over respectively the left and right inner ledges to lock the container pod in place in the container slot.

2. The modular travel storage system of claim 1, wherein each container pod comprises a container lid, which when opened provides access to the container interior.

3. The modular travel storage system of claim 2, wherein each container pod comprises a hinge and a container body, which encloses the container interior, wherein the container lid is hingedly connected to the container body with the hinge.

4. The modular travel storage system of claim 3, wherein the hinge is a living hinge.

5. The modular travel storage system of claim 1, wherein the container slot further comprises:

a top wall, which is mounted between top ends of the left and right slot walls.

6. The modular travel storage system of claim 1, wherein the container slot further comprises:

a rear wall, further comprising a rear inner ledge that protrudes inward along an inner side of the rear wall.

7. The modular travel storage system of claim 1, wherein each container pod comprises:

a) a container body, which encloses the container interior, such that an upper opening of the container body provides access to the container interior;

b) left and right rims that protrude outward along upper parts of left and right outer sides of the container body;

c) a rear rim that protrudes outward along an upper part of a rear outer side of the container body;

d) a container lid, which can be hingedly connected to the container body with a hinge, such that the container lid closes the upper opening when the container lid is in a closed configuration; and e) a top wall, which is mounted between top ends of the left and right slot walls such that the left, right, and rear rims are configured to slide in over respectively the left, right, and rear inner ledges to lock the container pod in place in the container slot;

such that the container lid is configured to slide along the top wall, such that the container lid is pressed against the top wall, such that the container lid is pressed closed, which thereby provides an additional sealing function of the container lid.

8. The modular travel storage system of claim 1, wherein each container pod comprises:

a container body, which encloses the container interior, such that an upper opening of the container body provides access to the container interior; and left and right rims that protrude outward along upper parts of left and right outer sides of the container body;

such that the left and right rims are configured to slide in over the left and right inner ledges to lock the container pod in place in the container slot.

9. The modular travel storage system of claim 8, wherein each container pod further comprises:

a rear wall, further comprising a rear inner ledge that protrudes inward along an inner side of the rear wall; and a rear rim that protrudes outward along an upper part of a rear outer side of the container body;

such that the rear rim is configured to slide in over the rear inner ledge when the container pod is locked in place in the container slot.

10. The modular travel storage system of claim 8, wherein the holder portion is made of a plastic material and the container body is made from a rubber material, such as silicone rubber.

11. The modular travel storage system of claim 1, wherein at least one container pod in the plurality of container pods further comprises at least one divider, which divides the container interior into at least two compartments.

12. The modular travel storage system of claim 2, wherein at least one container pod in the plurality of container pods further comprises at least one removable inner lid, which is mountable under the container lid.

13. The modular travel storage system of claim 12, wherein the at least one removable inner lid further comprises a plurality of apertures.

14. The modular travel storage system of claim 5, wherein at least one container pod comprises a container lid, which when opened provides access to the container interior wherein the container lid further comprises:

a label area, which is a flat area on a top surface of the lid; and a content label, wherein the content label is applied to the label area.

15. The modular travel storage system of claim 14, wherein the top wall further comprises:

an aperture;

such that the content label is visible through the aperture.

16. The modular travel storage system of claim 1, wherein the plurality of container pods comprises 2-10 container pods, and wherein each of the container pods is configured to contain 25-200 ml.

17. The modular travel storage system of claim 3, wherein the container body is transparent.

18. A modular travel storage system, comprising:

a) a holder portion, which comprises:

a plurality of container receptors; and b) a plurality of container pods, which each enclose a container interior;

wherein each container pod is configured to be detachably connectable to a corresponding container receptor;

wherein each container receptor is configured as a container slot, such that a corresponding container pod is configured to slide into the container slot from an outer side of the holder portion;

wherein the container slot further comprises:

left and right slot walls further comprising left and right inner ledges that protrude inwards along inner sides of the left and right slot walls; and a top wall, which is mounted between top ends of the left and right slot walls;

wherein at least one container pod comprises a container lid, which when opened provides access to the container interior, wherein the container lid further comprises:

a label area, which is a flat area on a top surface of the lid; and a content label, wherein the content label is applied to the label area wherein the top wall further comprises:

an aperture;

such that the content label is visible through the aperture.

* * * * *